US005802835A

United States Patent [19]

Stephan

[11] Patent Number: 5,802,835

[45] Date of Patent: Sep. 8, 1998

[54] SPINNING MACHINE NEGATIVE PRESSURE DISTRIBUTION SYSTEM

[75] Inventor: Adalbert Stephan, Bielngries, Germany

[73] Assignee: Rieter Ingolstadt Spinnereimaschinenbau AG, Ingolstadt, Germany

[21] Appl. No.: 792,656

[22] Filed: Jan. 31, 1997

[30] Foreign Application Priority Data

Feb. 23, 1996 [DE] Germany ..... 196 06 666.2

[51] Int. Cl.[6] ..... D01H 11/00

[52] U.S. Cl. ..... 57/304; 57/261; 57/263; 57/264; 251/129.12

[58] Field of Search ..... 57/300, 301, 302, 57/304, 305, 263, 261, 264; 18/312.1; 251/129.12

[56] References Cited

U.S. PATENT DOCUMENTS

| | | | |
|---|---|---|---|
| 3,914,676 | 10/1975 | Madonian et al. | 251/129.12 |
| 4,038,812 | 8/1977 | Stahlecker | 57/304 |
| 4,957,274 | 9/1990 | Hood et al. | 251/129.12 |
| 5,313,775 | 5/1994 | Binder et al. | 57/305 |
| 5,427,350 | 6/1995 | Rinkewich | 251/129.12 |
| 5,535,580 | 7/1996 | Sebastian et al. | 57/263 |

FOREIGN PATENT DOCUMENTS

| | | | |
|---|---|---|---|
| 0326748A1 | 8/1989 | European Pat. Off. . | |
| 2531044A1 | 1/1977 | Germany . | |
| 3726531 | 12/1988 | Germany | 57/302 |

OTHER PUBLICATIONS

German Search Report issued on May 31, 1996.

*Primary Examiner*—William Stryjewski
*Attorney, Agent, or Firm*—Dority & Manning

[57] ABSTRACT

A negative pressure distribution system for a textile spinning machine includes a negative pressure channel and a plurality of lines configured to deliver negative pressure to a device in the textile machine to carry out a desired task. A distributor is disposed between the negative pressure channel and the negative pressure lines. The distributor includes a housing having a variably positionable valve within the housing. The valve is positionable between a closed position wherein the negative pressure lines are pneumatically isolated from the negative pressure channel and a plurality of operable positions wherein at least one of the negative pressure lines is in communication with the negative pressure channel through the housing.

17 Claims, 4 Drawing Sheets

SPINNING MACHINE NEGATIVE PRESSURE DISTRIBUTION SYSTEM

BACKGROUND OF THE INVENTION

In spinning machines, such as rotor spinning machines for example, a method is known by which negative pressure is produced at different locations of the spinning machine by means of a negative-pressure source so as to be able to carry out maintenance or to move or treat the yarn or the fiber sliver in a purposeful manner. For the individual activities, different components are required so that special work can be carried out optimally. The components are e.g. yarn storage, suction nozzles, yarn end preparers, devices for the feeding of fiber sliver into the spinning machine or devices to constitute a yarn reserve on a bobbin. Often such components are installed in a service unit which can travel alongside the spinning machine. As soon as the service unit detects a spinning station in need of maintenance, it stops and carries out maintenance. It is then standard practice for the service unit to carry with it either a source of negative pressure or to establish a connection to the spinning machine through which negative pressure is conducted into the service unit. In order to feed the negative pressure in a targeted manner to the component needing it, a negative-pressure distributor is provided which subjects the individual components with negative pressure as needed. The connections of the individual components are each provided with a valve which reacts to a control signal in such a manner that it either allows negative pressure to reach the individual component through the negative-pressure channel, or shuts off the negative pressure. Therefore a valve which is actuated is required for each component. This plurality of components is very costly and furthermore requires a great regulating effort so that the different valves are actuated in the correct time sequence and for the correct duration.

OBJECTS AND SUMMARY OF THE INVENTION

It is therefore a principal object of the invention to create a simple, operationally secure and inexpensive device by means of which different components can be supplied with negative pressure from a central negative-pressure source. Additional objects and advantages of the invention will be set forth in part in the following description, or may be obvious from the description, or may be learned through practice of the invention.

The objects are attained through the characteristics of the invention. A distributor consists of a housing with connections for the negative pressure ducts as well as with a connection for the negative pressure channel. The housing is provided with a valve for the opening and closing of the connection of the negative pressure channel with at least one of the negative pressure ducts of the components. A distribution of the negative pressure among the individual components needing it is effected with advantageously few elements. Thanks to the small number of relatively easily produced elements, a less expensive and operationally more reliable distributor of negative pressure is above all created. With one single valve it is now possible to supply the negative pressure ducts in a targeted manner with negative pressure or to shut them off from the negative pressure. With few movable elements, low wear and low malfunction incidence is ensured. The apparatus according to the invention thus ensures that a reliable, low-maintenance, and low-cost element is used for the distribution of negative pressure.

If the connections of the negative pressure ducts of the components are essentially arranged next to each other in the housing in the sequence in which they are needed in a work cycle, this ensures in a simple manner that the negative pressure can be switched over rapidly from one negative pressure duct to the other. A typical work cycle is the piecing in a spinning machine, e.g. an open-end rotor spinning machine. Here the work phases provided are e.g. the aspiration, the cutting, preparing, storing and surrendering of the yarn end. If each of the connections of the negative pressure ducts is associated with the corresponding component which is next in line to be subjected to negative pressure, it is only necessary to displace the valve by one position in order to subject the component which is next in the work cycle with negative pressure.

If the connections of the negative pressure ducts have different cross-sectional surfaces, different flow velocities can be obtained in the negative pressure ducts. Thus it is possible to obtain better flowing conditions for different tasks such as e.g. yarn end preparation. Furthermore the utilization of smaller and larger cross-sectional surfaces creates the possibility for several negative pressure ducts to be opened at the same time. Here it is advantageous to place the connections in different planes, as the connections can be placed even closer to each other in this manner insofar as the cross-sectional surfaces are circular, for example. In such an arrangement the different connections are open in one position of the valve and can thus be subjected to negative pressure.

If the valve has a conical opening in cross-section for the connection between the negative pressure channel and at least one of the connections of the negative pressure ducts of the components, it is ensured that the valve creates favorable flow conditions. The flow losses in the valve or in the distributor can be minimized in this manner. Furthermore, the possibility is created for the valve to contact on one side different connections of the negative pressure ducts, while it always provides an opening to the negative pressure channel on the other side. Here it is especially advantageous if the greater width of the conical opening of the valve is facing the connection of the negative pressure channel. The conical opening can also be used to special advantage as part of a yarn storage into which the yarn is aspired and from which it is drawn off again as required.

If the smaller width of the conical opening has a cross-section which is at least equal to the largest cross-section of the connections of the negative-pressure ducts of the components, optimal flow through the negative-pressure duct is always ensured. By shifting the smaller width of the conical opening relative to the connection of the negative-pressure duct, a reduction of the cross-sectional surface is made possible.

In order to obtain a robust, simple and low-maintenance drive for the valve, a gear motor is advantageously selected. This makes it possible to use proven standard components which furthermore reduces costs. With the gear motor it is possible to precisely control the position of the valve. With an appropriate transmission of the gears, the tolerances in positioning as well as precision in repeatability are sufficient.

The device is especially simple and reliable if the valve is a rotary valve. In this manner it is possible, through a simple rotational movement, under certain conditions even in one direction only, to make all connections between the negative pressure lines and the narrow opening of the valve controllable. Furthermore, a closing of the distributor can be obtained with the same movement, in that the rotary valve assumes a position in which no passage from the negative-pressure channel into one of the negative-pressure lines takes place.

An especially simple possibility for the positioning of the rotary valve is provided when a positioning disk interacting with a sensor is installed on said rotary valve. The sensor is advantageously a limit switch which scans different switching flags arranged at the radius of the positioning disk. Through the arrangement of the switching flags, the control of the drive is able to go to certain positions or to stop at certain positions until an activity has been carried out. The individual positions correspond to the connections of the negative-pressure lines and are assigned to these. Depending on programming, the gear motor is able to stop for a given predetermined time in the presence, but also in the absence, of a switching flag and to continue moving the rotary valve on to the next stop only at the end of that time or upon receiving a different signal. If the positioning disk is substantially of circular configuration, the switching flags are located at the radius of the positioning disk. In case that the valve can be displaced in a linear manner, it is advantageous for the positioning disk to be rectangular. In that case the switching flags are to be installed on the outer sides of the positioning disk.

In order to ensure that the yarn end does not interfere with the operation of the distributor by being aspired into the moving parts or into the negative-pressure channel, it is advantageous to provide a yarn cutting device in the area of the connection of the negative-pressure channel. A yarn cutting device in which a displaceable knife is installed in the cross-section of the connection of the negative-pressure channel has proven advantageous. A yarn end extending into the negative-pressure channel is severed by means of this displaceable knife and can be aspired through the negative-pressure channel and be conveyed into a waste container.

It is an especially great advantage, particularly in a spinning machine with several work stations, that the distributor is installed in a service unit traveling alongside the spinning machine. In this manner, the utilization of identical components, such as the distributor, need not be used several times in the machine, thus increasing its cost.

The invention is described below through examples of embodiments.

DETAILED DESCRIPTION OF THE PREFERRED EMBODIMENTS

Figure 1:
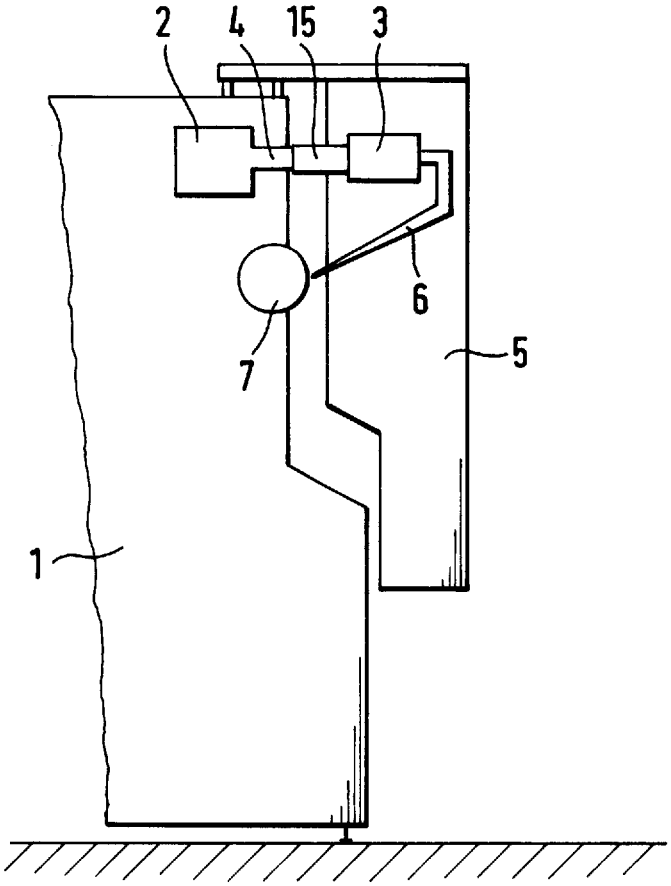
FIG. 1 shows a spinning machine with a traveling service unit.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used with another embodiment to yield still a further embodiment. It is intended that the present invention cover such modifications and variations as come within the score of the appended claims and their equivalents.

In FIG. 1 a spinning machine 1, here an open-end rotor spinning machine, is shown. A service unit 5 is able to travel on the spinning machine 1 via a holding device. The service unit 5 controls and services the plurality of spinning stations provided next to each other on the spinning machine. Each spinning station is provided, among other things, with a winding device with a bobbin 7. A central negative-pressure channel 2 is installed in the longitudinal direction of the spinning machine 1. The negative pressure is produced in the negative-pressure channel 2 by means of a source of negative pressure which is not shown. At each spinning station a connection 4 is provided which provides the spinning station with a connection to the central negative-pressure channel 2. In the service unit 5 a negative-pressure channel 15 is provided as a connecting segment which can be shifted to the connection 4 of the spinning machine 1. As soon as the connection is established, the negative pressure from the central negative-pressure channel 2 appears in the connecting pipe 4 and in the negative-pressure channel 15 and thereby in a distributor 3. As shall be explained in further detail below, several negative-pressure lines are connected to the distributor 3. FIG. 1 of the example of an embodiment shows a negative-pressure line letting out in a suction pipe 6. This suction pipe 6 can be used to aspire a yarn end on the bobbin 7 and to prepare it for a piecing process. Advantageously, each device or component in the service unit which works with negative pressure, is provided with its own negative-pressure line up to distributor 3. As soon as one of the components requires negative pressure for its activity, the distributor 3 is switched in such a manner that negative pressure from the negative-pressure channel 2 enters the appertaining negative pressure line going to the component through the connecting pipes 4, the negative-pressure channel 15, and the distributor 3.

In another advantageous embodiment, a source of negative pressure with a negative-pressure channel 15 instead of the negative-pressure channel 2 and the connecting pipe 4 are installed in the service unit 5. The source of negative pressure and the negative-pressure channel 15 are moved alongside the spinning machine 1 in this case, together with the service unit 5.

Components connected to the distributor 3 via negative-pressure lines may be suction nozzles for yarns or for fiber sliver. They may be provided for the preparation of yarn ends or for the formation of yarn reserve and yarn storage. In special piecing processes working with fiber flow deflection, the component can serve as a suction trunk to aspire from an opening roller or a fiber feeding channel. The components may be located in the service unit 5 as well as in the spinning machine 1. The same applies to the distributor 3. The distributor 3 can also be used in other spinning machines, such as e.g. winding machines or ring spinning machines.

When the service unit 5 is not at the connecting pipe 4 of a given spinning station, the connecting pipe 4 is closed by means of a valve. The closing of the connecting pipe 4 ensures that no unnecessary negative-pressure losses occur in the negative-pressure channel 2. Only the passing of the service unit 5 or docking of the service unit 5 at a spinning station establishes a connection between the connecting pipe 4 and the negative-pressure channel 15.

Figure 2:
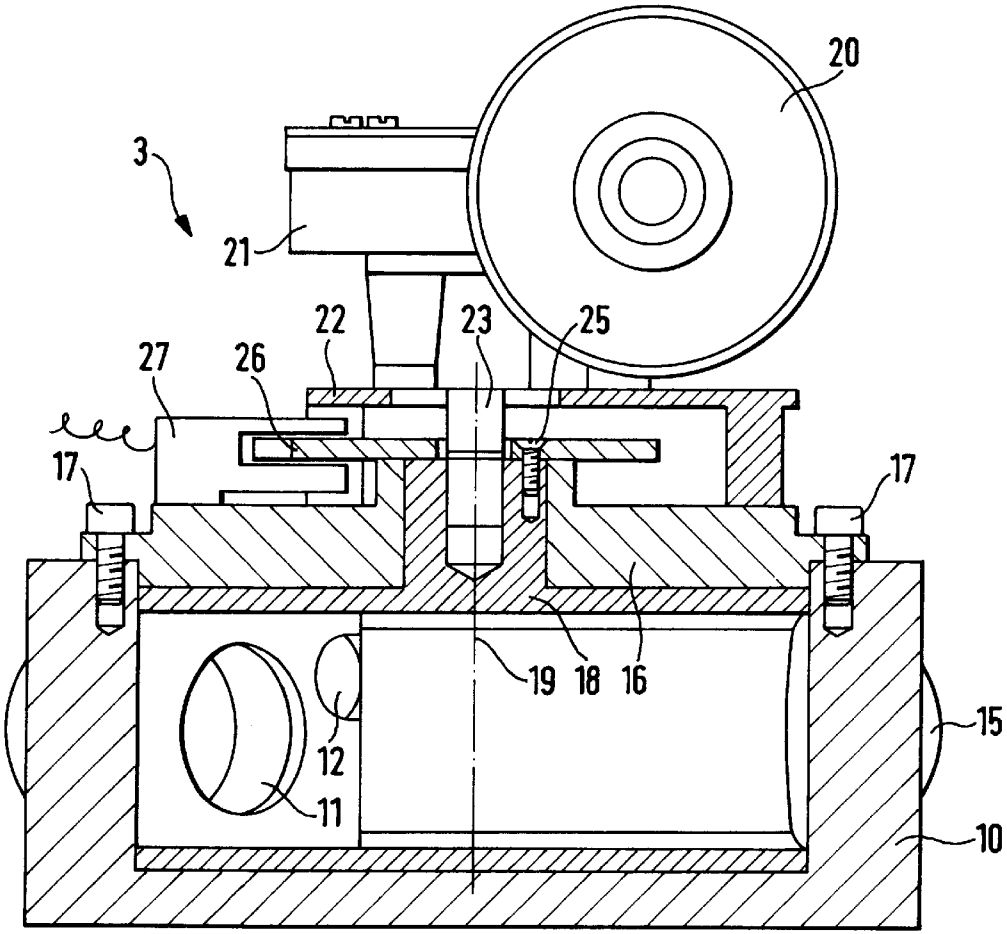
FIG. 2 shows a distributor in cross-section.

FIG. 2 shows a distributor 3 in cross-section. The distributor 3 consists of a pot-shaped housing 10 in the sides of which openings are made for the negative-pressure lines and the negative-pressure channel 15. In the drawing, the openings of the negative-pressure line 11 and of the negative-pressure line 12 can be seen. Additional negative-pressure lines are located behind a side of a rotary valve 18 and are not visible in this drawing. The housing 10 is closed by a cover 16 by means of screws 17. The connection between the two parts should be as tight as possible in order to avoid losses in negative pressure. The negative-pressure lines 11, 12, 13 and 14 are opened or covered and thereby closed by the rotary valve 18. This also applies to the negative-pressure channel 15 which is connected to the source of negative pressure (not shown). The rotary valve 18 can swivel around its axis 19 in such a manner that it establishes a connection between the negative-pressure channel 15 and one or several of the negative-pressure lines 11, 12, 13 or 14. The rotary valve 18 can furthermore be brought into a position in which the negative-pressure channel 15 is closed, so that none of the negative-pressure lines 11, 12, 13 or 14 is supplied with negative pressure.

In the present example of an embodiment as shown in FIG. 2, the rotary valve 18 of the distributor 3 is driven and adjusted via a motor 20 and gearing 21. Motor 20 and gearing 21 are secured on a platform 22 on the cover 16. The drive shaft 23 of gearing 21 is connected to the rotary valve 18 in the axis 19 of said rotary valve 18. The rotary valve 18 can be rotated into any desired position by actuating the motor 20.

A positioning disk 26 is connected by means of screws 25 permanently to the rotary valve 18 or to the shaft 23. The positioning disk 26 interacts with a limit switch 27. The motor 20 is controlled via the limit switch 27. The needed position of the rotary valve 18 is set on the positioning disk 26. When the rotor and gearing 21 rotates the shaft 19, the rotary valve 18 and the positioning disk 26, the rotary valve 18 is rotated until the limit switch 27 detects a change in state of the positioning disk 26 and switches off the motor 20. Following a predetermined time period or based on another signal, the motor 20 is switched on again and moves forward in steps by one or several positions of the positioning disk 26.

Figure 3:
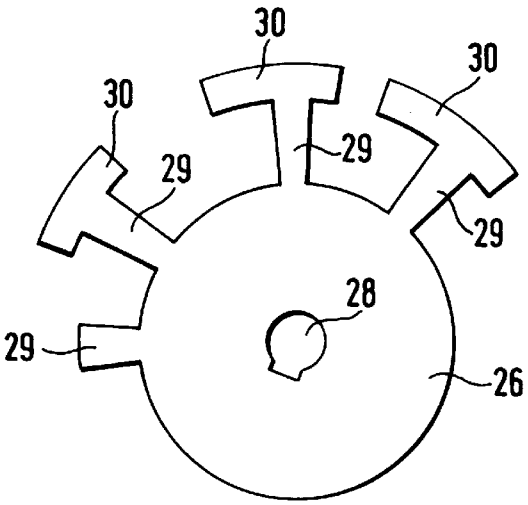
FIG. 3 shows a positioning disk.

FIG. 3 shows a positioning disk 26 with a bore 28. The bore 28 serves to center the positioning disk 26 relative to the shaft 23 of the gearing 21. It is important for the positioning disk 26 to be non-rotatably connected to the rotary valve 18 or the shaft 23. This is achieved by means of a groove and spring connection and/or by means of screws 25. This ensures that precise positioning of the rotary valve 18 relative to the negative-pressure lines 11, 12, 13 and 14 as well as negative-pressure channel 15 is achieved.

Switching flags 29 and 30 are placed at the periphery of the positioning disk 26. The switching flags 29 and 30 interact with the limit switch 27. In the present example, the limit switch 27 is made in the form of a double proximity switch, and this means that two proximity switches are installed in the limit switch. One of the proximity switches of the limit switch 27 interacts with the inner switching flag 29 and the other proximity switch with the outer switching flags 30. Through a logical linking of the signals of the two proximity switches in the limit switch 27, the control of the motor 20 is made possible. The logical linking may be of such nature that the motor is stopped when a proximity switch for the outer switching flag 30 and the inner switching flag 29 is affected. It is also possible to provide a circuit in which the motor 20 is stopped when only the outer switching flag 30 is affected. In a variant of the switching flag, in which only the inner switching flag 29 is installed on the switching flags 29 and 30, it can be decided for the rotary valve 18 has closed the distributor 3. Starting from this position, the controls of the rotary valve 18 or of the motor 23 is able to deduce that the rotary valve 18 is in its starting position. This ensures that in case of power failure, shutdown or other influences due to which the device must be adjusted again, a zero point is determined from which the device can be started anew. The installation of the switching flags 29 and 30 at the periphery of the positioning disk 26 can be effected according to the requirements or according to the connections of the negative-pressure lines 11, 12, 13 and 14 and of the negative-pressure channel 15. In addition, other forms of the positioning disks and of the switching flags are also possible. It is important here that the interaction between positioning disk 26 and limit switch 27 ensures a secure position of the rotary valve 18 before the connections of the negative-pressure lines, even after a failure.

In FIGS. 4*a* to 4*f*, the functioning of the device according to the invention is described through an example of an embodiment. In the housing 10 of the distributor 3, the negative-pressure lines 11, 12, 13 and 14 as well as the negative-pressure channel 15 are installed. The negative-pressure lines 11 to 14 have in part different diameters. The negative-pressure line 12 is shown offset in the drawing plane relative to the other negative-pressure lines 11, 13 and 14. The placement of the negative-pressure lines 11 to 14 relative to the negative-pressure channel 15 must be such that in at least one position of the rotary valve 18 no connection exists between the negative-pressure channel 15 and any of the negative-pressure lines 11 to 14. On the other hand, a suitable form of the rotary valve 18 must ensure that a connection between the negative-pressure channel 15 and only one of the negative-pressure lines 11, 12, 13 or 14 is established. It is also advantageous if the narrow opening 32 is of such dimension relative to the cross-sections of the negative-pressure lines 11, 12, 13 and 14 that it is able to open also several negative-pressure lines in certain positions. The wide opening 31, on the contrary, must be sized so that it opens the negative-pressure channel 15 every time the narrow opening 32 is in the area of one of the negative-pressure lines 11 to 14. For this reason, an open cross-section of the rotary valve 18 with an essentially conical form has therefore proven to be advantageous. This also ensures that a minimum of flow losses are produced in the rotary valve 18, since the flow in such a form is able to go without great deflections from the negative-pressure lines 11 to 14 into the negative-pressure channel 15.

Figure 4A:
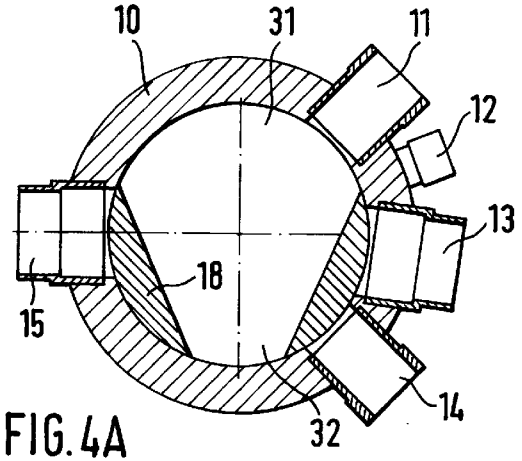
FIGS. 4*a* to 4*f* show different positions of a rotary valve in the distributor.

FIG. 4*a* shows the basic position of the rotary valve 18 of the distributor 3. In this starting position the negative-pressure channel 15 is closed. The negative-pressure lines 11 to 14 are not fed negative pressure. Although the negative-pressure lines 11 and 12 are not directly closed by the side of rotary valve 18, no negative pressure enters these negative-pressure lines 11 and 12 since the second side of the rotary valve 18 closes the negative-pressure channel 15.

To achieve a good seal between the rotary valve 18 and the negative-pressure channel 15 or the negative-pressure lines 11 to 14, it is necessary for the housing 10 of the distributor 3 to be pressed very tightly against the walls of the rotary valve 18. This can be achieved by means of a precise finishing or by means of sealing lips which are inserted into the rotary valve 18. Under some conditions it may, however, also be admissible that the seal of the individual lines not be totally tight since the negative pressure appears at the negative-pressure channel 15 only when the service unit 5 has docked at the negative-pressure channel 2 of the spinning machine 1 or at the connecting pipe 4 if the distributor 3 is installed in a service unit 5.

Alternatively, the negative-pressure source which is located in the service unit 5 only operates when the service unit 5 has docked at a spinning station of the spinning machine 1 and requires negative pressure for its service activities.

Figure 4B:
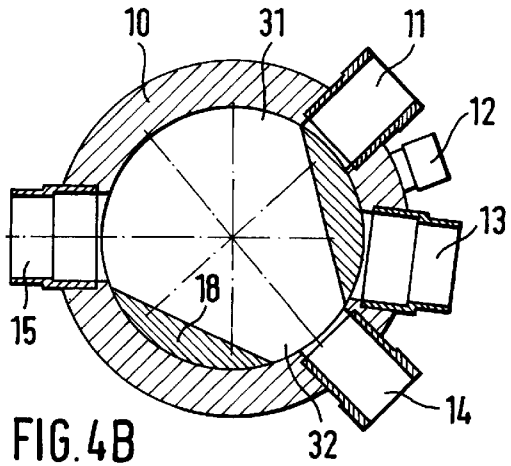

FIG. 4*b* shows a position of the rotary valve 18 in which the negative-pressure line 14 is connected to the negative-pressure channel 15. In this position the negative-pressure lines 11 to 13 are closed by a side of the rotary valve 18. The negative-pressure line 14 may be used to supply a fiber sliver feeding apparatus for instance, in which the fiber sliver being presented to the spinning station is aspired and is introduced into the spinning station.

Figure 4C:
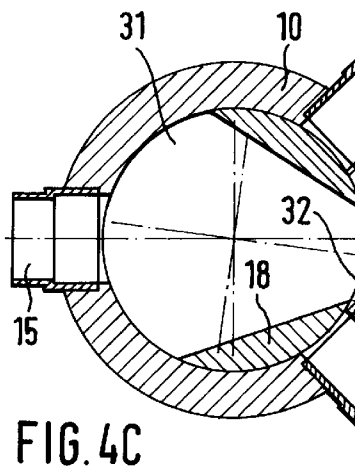

In FIG. 4*c* the narrow opening 32 of the rotary valve 18 is assigned to the negative-pressure line 13. In this manner a connection between the negative-pressure line 13 and the negative-pressure channel 15 is created. The negative-pressure lines 11 and 12 are closed by a side of the rotary valve 18 and the negative-pressure line by another side of the rotary valve 18. The negative-pressure line 13 may be used for example to provide negative pressure to a suction nozzle by means of which a yarn end is located on a bobbin.

Figure 4D:
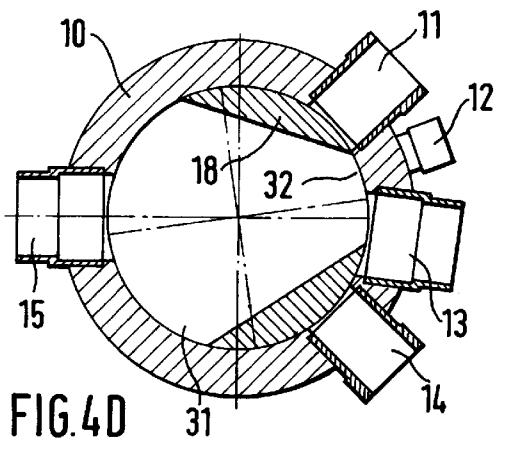

Once the yarn end on the bobbin has been aspired, it continues to be held in the suction nozzle and is fed to a yarn preparation station device. In the yarn preparation device, the yarn end is prepared for subsequent piecing. To carry out the process step "holding the yarn end" and "preparing the yarn end", the rotary valve 18 is rotated in such a manner as shown in FIG. 4*d*, that the narrow opening 32 is assigned to the negative-pressure line 12 and to the negative-pressure line 13. In this manner, the yarn end is held by the negative pressure in the negative-pressure line 13 and is prepared through the negative pressure in the negative-pressure line 12. In this position the negative-pressure line 11 is closed by one side of the rotary valve 18 and the negative-pressure line 14 by the other side of the rotary valve 18. The narrow opening 32 of the rotary valve 18 lies in the area of the negative-pressure line 12 and of the negative-pressure line 13 and thus provides both lines with negative pressure.

Figure 4E:
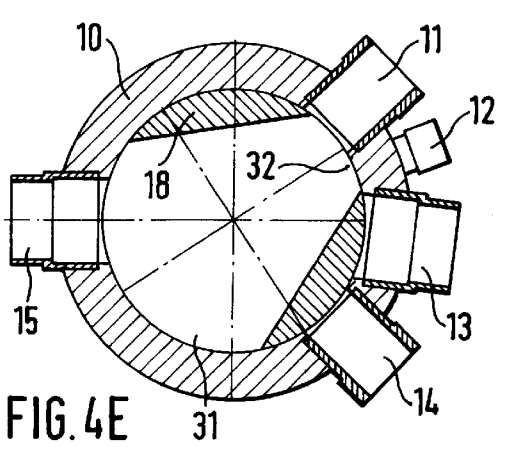

In FIG. 4*e* the rotary valve 18 is shifted by another position. In this drawing the narrow opening 32 is located in front of the negative-pressure line 11 and the negative-pressure line 12. In the embodiment described above, the negative-pressure line 12 is thus provided with negative pressure for the preparation of the yarn end. Furthermore negative pressure is provided to the negative-pressure line 11. The negative-pressure line 11 may be connected to a yarn storage in which a yarn is held in a given position for piecing. In this position the negative-pressure lines 13 and 14 are completely closed by a side of the rotary valve 18.

Figure 4F:
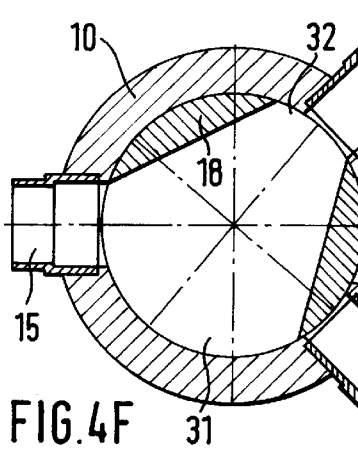

In FIG. 4*f* the rotary valve 18 is in a position in which only the negative-pressure line 11 is subjected to negative pressure. The negative-pressure lines 12, 13 and 14 are closed by one side of the rotary valve 18. A yarn storage in which the yarn is placed during piecing or after piecing to receive excess yarn is connected to the negative-pressure line 11. Following piecing, the rotary valve 18 can again be moved back into the position shown in FIG. 4*a*, so that the distributor 3 closes off the negative pressure appearing at the negative-pressure channel 15.

Figure 5:
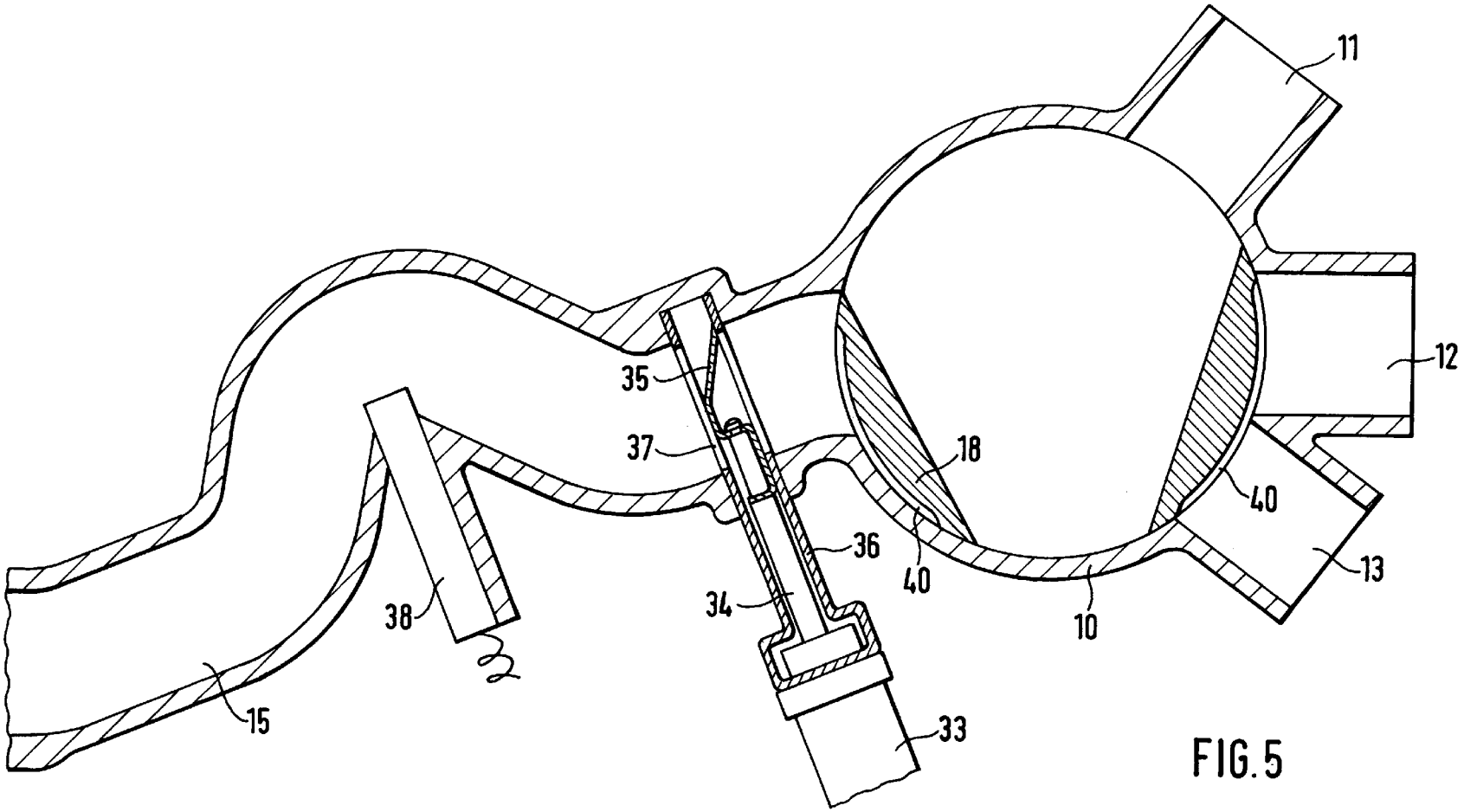
FIG. 5 shows a distributor with a yarn cutting device in cross-section.

In particular in the positions of FIGS. 4*c* to 4*f*, it is possible that a yarn end or a yarn loop is sucked into the distributor 3 and is stored temporarily. In order to prevent the aspired yarn segment from blocking the distributor 3 or from hindering the rotary valve 18 in its mobility, and also to prevent a yarn end to be carried along from the service unit 5 on its way alongside the spinning machine 1 and from being unwound from the bobbin, it is advantageous, according to FIG. 5, to provide a yarn cutting device. The yarn cutting device consists of a pneumatic cylinder 33 on which a rod 34 is installed. The rod 34 which can be moved back and forth has a knife 35 at its end. The rod 34 moves the knife 35 in a guide 36. The guide 36 has an opening 37 in the area of the negative-pressure channel 15. While the distributor 3 operates as shown in FIGS. 4*b* to 4*f*, the knife 35 is in a retracted position which is not shown. In this manner the opening 37 of the guide 36 is open and a yarn can be aspired through the negative-pressure line, the open cross-section of the negative-pressure channel 15 and through the opening 37. Before the end of the work cycle the pneumatic cylinder 33 is actuated and moves the knife 35 in the guide 36 at a right angle to the negative-pressure pressure channel 15 into the shown position. Thereby a yarn which is in the area of the yarn cutting device is severed. The severed yarn end is aspired through the negative-pressure channel 15 and continues moving into a waste container which is not shown. The other portion of the yarn continues to remain in one of the negative-pressure line 11 to 13 and in the rotary valve 18. It can then be drawn off for further processing from the negative-pressure line.

Another manner of operation consists in the device aspiring a yarn end as far as into the negative-pressure channel 15. As soon as the yarn end is in the area of a sensor 38 which is located in the negative-pressure channel 15, a signal is transmitted to the yarn cutting device. This signal causes the pneumatic cylinder 33 to be actuated and the knife 35 cuts the yarn at a defined location. The yarn end located on the side of the negative-pressure channel 15 is removed into the waste container while the yarn end on the side of the distributor 3 has a defined length. In this manner a targeted continued processing by means of one of the actors or handling devices is made possible.

The sensor 38 is advantageously located in a bend of the negative-pressure channel 15. This ensures that the aspired yarn end is located in proximity of the sensor 38 and that the sensor 38 will recognize the aspired yarn end without fail.

For a good seal or for easy and reliable rotation of the rotary valve 18, it is advantageous for pockets 40 to be provided in the sides of the rotary valve 18. These pockets 40 reliably prevent a jamming of the rotary valve 18 in the housing 10 by aspired fiber particles or yarn segments. The fibers or yarn remnants have sufficient room available in the pockets 40 so that the rotation of the rotary valve 18 remains possible. The pockets 40 are cleaned by the negative pressure in the negative-pressure channel 15 during a rotation along the connection of the negative-pressure channel 15.

Instead of the rotary valve 18, it is in principle also possible to provide a valve in the distributor 3 which is displaced in a linear manner. In that case, the negative-pressure channel 15 is located in an essentially rectangular housing 10 on one side of said housing 10 and the negative-pressure lines 11 to 14 are located on the side across from the negative-pressure channel 15. In a linear displacement of the valve, individual or several negative-pressure lines 11 to 14 are opened or closed in the same manner as in the previous example of an embodiment. The movement of the valve is however easily realized with the rotary valve 18 in the embodiment shown, since fewer and simpler components are needed for the displacement of the valve in a rotary valve 18. In a linear valve, instead of a positioning disk 26, an essentially rectangular positioning plate would be required in order to provide the limit switch 27 with appropriate signals.

The negative pressure components may also be other than those handling devices described above. Thus all the devices which operate with negative pressure for the actuation of another device or directly for the treatment of a yarn can be supplied through the distributor 3. One could think here, among other things, of cutting devices, clamping devices or cleaning devices. Several actors which are to be subjected simultaneously to negative pressure can also be connected to one single connection of the negative-pressure line. It is also possible to connect one actor which is needed several times in the work cycle to several connections and thus to cause the valve to be moved on in steps in one direction. It will be apparent to those skilled in the art that various modifications and variations can be made in the present invention without departing from the scope and spirit of the invention. It is intended that the present invention cover such modifications and variations as come within the scope of the claims and their equivalents.

What is claimed is:

1. A textile spinning machine utilizing negative pressure to carry out a plurality of operational tasks, said spinning machine comprising:

a negative pressure channel and a plurality of negative pressure lines in pneumatic communication with said negative pressure channel, each of said negative pressure lines configured to deliver negative pressure to a negative pressure component of said spinning machine to perform at least one of said operational tasks;

a distributor operably disposed between said negative pressure channel and said negative pressure lines;

said distributor comprising a housing, said negative pressure lines and said negative pressure channel in pneumatic communication with said housing, said distributor further comprising a valve variably positionable within said housing between a closed position wherein said negative pressure lines are pneumatically isolated from said negative pressure channel and a plurality of operable positions wherein each of said negative pressure lines is in pneumatic communication with said negative pressure channel through said housing in at least one of said operable positions.

2. The spinning machine as in claim 1, wherein said negative pressure lines are disposed in an ordered position relative to said housing and movement of said valve within said housing so that said valve connects said negative pressure lines to said negative pressure channel in a desired operational sequence as said valve moves within in said housing in a single direction to sequentially connect said negative pressure lines to said negative pressure channel.

3. The spinning machine as in claim 1, wherein each of said negative pressure lines is connected to said housing with an opening, said openings having different cross-sectional areas.

4. The spinning machine as in claim 3, wherein said valve has a conical passage defined therethrough, said passage selectively connecting at least one of said negative pressure lines to said negative pressure channel as said valve moves within said housing.

5. The spinning machine as in claim 4, wherein said conical passage has a wider width opening disposed adjacent said negative pressure channel and a smaller width opening disposed adjacent said negative pressure lines, said wider width opening being wide enough so as to connect said negative pressure channel with any one of said negative pressure lines as said valve moves within said body.

6. The spinning machine as in claim 5, wherein said smaller width opening has a cross-sectional area which is at least equal to the largest cross-sectional area of said negative pressure line openings.

7. The spinning machine as in claim 5, wherein said conical passage is movable with said valve so that said smaller width opening is presentable to any one of said negative pressure line openings.

8. The spinning machine as in claim 1, further comprising a motor operably connected to said valve so as to variably position said valve within said housing.

9. The spinning machine as in claim 1, wherein said valve comprises a rotary valve that rotates within said housing.

10. The spinning machine as in claim 1, further comprising a positioning disk device operably configured with said valve so as to define a number of variable positions for said valve within said housing.

11. The spinning machine as in claim 10, further comprising a sensor device configured with said positioning disk device.

12. The spinning machine as in claim 11, wherein said sensor comprises a limit switch.

13. The spinning machine as in claim 11, further comprising a plurality of switching flag devices disposed on said positioning disk device, said sensor sensing said switching flag devices.

14. The spinning machine as in claim 1, further comprising a connection area between said negative pressure channel and said negative pressure lines, and a cutting device operably disposed in said connection area to cut a yarn that has been aspired into said distributor.

15. The spinning machine as in claim 14, wherein said cutting device comprises a knife device.

16. The spinning machine as in claim 15, wherein said knife device is pneumatically actuated.

17. The spinning machine as in claim 1, further comprising a service unit operably configured to travel alongside work stations defined in said spinning machine, said distributor disposed in said service unit and connectable to said negative pressure channel at said work stations.

* * * * *